US005761980A

United States Patent [19]

Ima et al.

[11] Patent Number: 5,761,980

[45] Date of Patent: Jun. 9, 1998

[54] SHEET SLITTING APPARATUS

[75] Inventors: Eiji Ima, Komaki; Isao Kato, Aichi, both of Japan

[73] Assignee: Isowa Corporation, Kasugai, Japan

[21] Appl. No.: 635,511

[22] Filed: Apr. 22, 1996

[30] Foreign Application Priority Data

Apr. 28, 1995 [JP] Japan ..... 7-129188

[51] Int. Cl.[6] ..... B26D 1/24

[52] U.S. Cl. ..... 83/500; 83/425.4; 83/508.3; 83/659

[58] Field of Search ..... 83/500, 501, 502, 83/508.3, 503, 504, 505, 506, 553, 425.4, 562, 659, 425.3, 498; 493/60, 66, 371

[56] References Cited

U.S. PATENT DOCUMENTS

| | | | |
|---|---|---|---|
| Re. 35,086 | 11/1995 | Paulson | 83/13 |
| 451,278 | 4/1891 | Pope et al. | 83/504 |
| 2,567,634 | 9/1951 | Bosshard | 83/500 |
| 2,637,395 | 5/1953 | Muller | 83/505 |
| 3,614,906 | 10/1971 | Hall | 83/500 |
| 4,233,869 | 11/1980 | Meyer et al. | 83/500 |
| 5,090,281 | 2/1992 | Paulson | 83/13 |

FOREIGN PATENT DOCUMENTS

| | | | |
|---|---|---|---|
| WO91/13733 | 9/1981 | WIPO | B26D 7/08 |

*Primary Examiner*—Kenneth E. Peterson
*Attorney, Agent, or Firm*—Ronald R. Snider

[57] ABSTRACT

The sheet slitting apparatus 1 comprises a disk-like slitting blade 23 and a guiding member 52. The slitting blade 23 rotates along the direction of the sheet feeding, and can move in a direction crossing over the sheet feeding direction. The blade-guides 52 is located in opposition to the slitting blade 23 and comprises a plurality of blade-guides which are arranged juxtaposed each other in a direction crossing that of the sheet feeding, and can displace elastically along the direction of their own arrangement, respectively. The sheet S is fed between the slitting blade 23 and the guiding member 52, and the tip of the slitting blade 23 intrudes between adjacent blade-guides 50 thereby slitting the sheet S along the longitudinal direction thereof.

4 Claims, 11 Drawing Sheets

SHEET SLITTING APPARATUS

FIELD OF INVENTION

This invention relates to a sheet slitting apparatus for longitudinally slitting a sheet, such as corrugated board, fed in its longitudinal direction with a rotating thin blade.

BACKGROUND OF INVENTION

A conventional slitting apparatus for longitudinally slitting a sheet (such as corrugated board) fed in its longitudinal direction comprises a pair of slitting blades which are arranged on upper and lower sides of the sheet and rotated in opposite directions. The blades are positioned so as to overlapping each other at the flat side of the tip in a designated length. The sheet is horizontally fed between the blades and slit along the feeding direction.

In such type of the apparatus, each blade has a relatively large thickness and may damage the slit edge of the sheet unless the tip overlapping length is severely optimized according to the thickness of the sheet, whereby the quality of the webs slit from the sheet may be lost. Furthermore, the clearance between the blades should be also adjusted very precisely since the condition of the slit edge of the sheet is strongly affected. Such adjustment is very delicate and difficult operation so that it requires high operation skill and consumes long time.

For solving such problem, a slitting apparatus comprising a thin slitting blade (generally, the thickness is less than 2 mm) and a sheet supporting device equipped with two rollers arranged in opposition to the blade has been proposed. In this apparatus, the tip of blade is positioned in the gap between the two rollers in no contact therewith, and rotated at a high speed of 1.5–5 times as high as the sheet feeding speed for slitting the sheet. The construction of the apparatus becomes simple since only one blade is used and has an advantage that a thin blade does not damage the slit edge of the sheet.

For changing the number or the width of the webs slit from the blade (so called "order-changing") in the apparatus mentioned above, the blade and the supporting device should be traversed along the width of the sheet for changing their positions. The blade is supported movably between two positions, i.e., the slitting position where the tip of the blade is located in the gap between the rollers beyond the feeding line of the sheet, and the idling the position remote from the feeding line. Receiving a command of order changing, the blade is moved from the slitting position to the idling position, traversed to the new position of slitting along with the supporting device, then moved back to the slitting position for restarting the sheet slitting.

The rollers of the sheet slitting device support the sheet from the opposite direction of the blade and allow the entrance of the blade in the gap for slitting. For achieving a good condition of slitting, it is very important to set clearances between both sides of the blade and adjacent rollers to a small value, more specifically to be a little larger than the blade thickness. In this case, however, the roller-gap becomes so narrow that only a small mismatch between the blade and the roller-gap may cause a fracture of the blade due to a collision with the roller when the blade returns to the slitting position. Therefore, the positioning of the blade and the supporting device for order-changing should be performed carefully and precisely. This may cause problems such as of increase in the price of the apparatus or of time-consuming for the adjustment.

SUMMARY OF THE INVENTION

The sheet slitting apparatus of this invention is for longitudinally slitting a sheet fed in the longitudinal direction thereof, and is constituted as follows for solving aforementioned object. That is to say, the apparatus comprises a disk-like slitting blade and a guiding member. The slitting blade rotates in the sheet feeding direction, and can move crossing over the sheet feeding direction. The guiding members is arranged in opposition to the slitting blade and comprises a plurality of blade-guides which are arranged juxtaposed each other in a direction crossing that of the sheet feeding, and can displace elastically along the direction of their own arrangement, respectively. The sheet is fed between the slitting blade and the guiding member, and the tip of the slitting blade intrudes between adjacent blade-guides thereby slitting the sheet along the longitudinal direction thereof.

The blade-guides displace elastically along the direction of their own arrangement when the slitting blade intrudes between the adjacent blade-guides interfering with them, so that the blade-fracture can be avoided during the repositioning of the blade for order-changing. Furthermore, the potential of the blade-fracture becomes so small that time for positioning the blade and the blade-guides may be saved significantly, and the order-changing of the sheet can be performed efficiently.

The guiding member may comprise a plurality of circular rolling elements as the blade-guides, which can rotate in the sheet feeding direction and can displace elastically along the rotating axis thereof. According to this construction, the rolling elements rotate following the sheet feeding, so that the sheet can be fed smoothly. In this case, the circular rolling elements can be driven by a driving means (such as a motor) so as to rotate uniaxially in the sheet feeding direction.

The circular rolling elements can be constituted as supporting disks each of which is formed in a shape of a thin plate with a flexible material. Circular rolling elements made of flexible material can deflect following the intrusion of the blade, so that they are superior in an effect of relaxing the interference with the blade. The flexible material preferably consists of plastics or fiber reinforced plastics (for example, plastics reinforced with glass or carbon fibers).

In this case, the plurality of supporting disks can be arranged so as to form gaps between the ones adjacent each other, each of which is narrower than the thickness of the slitting blade. The tip of the slitting blade is to enter into the gap with deflecting the supporting disks on both sides. According to this construction, no clearance is formed between the blade and the supporting disks, so that the condition of the slit edge of the sheet becomes more excellent.

The supporting disks can be mounted on a supporting shaft so as to rotate integrally with it. The supporting shaft is arranged along the width of the sheet and can rotate in the sheet feeding direction. In this case, a spacer having a diameter smaller than each supporting disk and a thickness smaller than the slitting blade is inserted between each adjacent supporting disks thereby forming the gap.

The guiding member can be constituted so as to move to and from the sheet between a supporting position, where said blade-guides allow the entrance of the slitting blade into said gap, and an idling position remote from the supporting position.

The slitting blade can be constituted so as to move along the width of the sheet, while the blade-guides can move integrally along the width of the sheet corresponding to the movement of the slitting blade. More specifically, the plurality of blade-guides can be arranged in a section shorter than the width of the sheet and can move integrally along the width of the sheet corresponding to the movement of the slitting blade. According to this construction, the number of blade-guides can be saved.

The slitting apparatus of this invention can comprise plural slitting blades arranged along the width of the sheet. In this case, plural guide members are arranged corresponding to each said slitting blade. Each guide member comprises plural blade-guides arranged in a section shorter than the width of said sheet. The guide members can move along the width of said sheet independently. According to this construction, the number of blade-guides can be saved. The slitting blades can be constituted so as to move to and from the sheet between a slitting position and an idling position. Corresponding to this, each guiding member may be constituted so as to move to and from the sheet between a supporting position and an idling position.

The apparatus can comprise a guide rail arranged along the width of the sheet, a traversing portion which can move along the guide rail and can stop at an arbitrary position on the guide rail, a supporting shaft mounted on the traversing portion rotatively in the sheet feeding direction. The plurality of blade-guides can be formed as a plurality of circular rolling elements which are mounted on the supporting shaft so as to rotate integrally with the shaft and to be able to displace elastically along the shaft. According to this construction, the blade-guides mounted on the traversing portion can be traversed smoothly along the guide rail, so that the efficiency and the accuracy for positioning the blade-guides may improve.

In a further specific constitution, a threaded shaft is arranged along the guide rail, and a nut toothed on its circumference and screwed on the threaded shaft is mounted integrally on the traversing portion along with a motor which rotates the nut by means of a gear engaging with the teeth formed on the nut. The motor rotates the nut thereby moving the traversing portion along the threaded shaft. This constitution is particularly advantageous for moving plural guiding members (corresponding to plural blades) independently each other.

The blade-guides can be arranged fixedly along the width of the sheet at least in the section comprising the range of the movement of the slitting blade. According to this construction, there is no need to adjust the position of the blade-guides, so that order-changing may be performed more efficiently. The blade-guides can be, for example, arranged over the total width of the sheet. This constitution can comprise a supporting shaft which can rotate in the sheet feeding direction. The guiding member can comprise a plurality of circular rolling elements as blade-guides, which are mounted on the supporting shaft so as to rotate integrally with the shaft and to be able to displace elastically along the shaft.

The apparatus of this invention can comprise a guide rail arranged along the width of the sheet, a slitting yoke which can move along the guide rail and can stop at an arbitrary position on the guide rail, a slitting head which is mounted on the slitting yoke and can move to and from the sheet. The slitting blade is rotatively mounted on the slitting head. According to this construction, the blade mounted on the slitting head can be traversed smoothly along the guide rail, so that the efficiency and the accuracy for positioning the blade may improve.

DETAILED DESCRIPTION OF THE PREFERABLE EMBODIMENTS

Several embodiments of this invention will now be described with reference to drawings.

(first embodiment)

Figure 1:
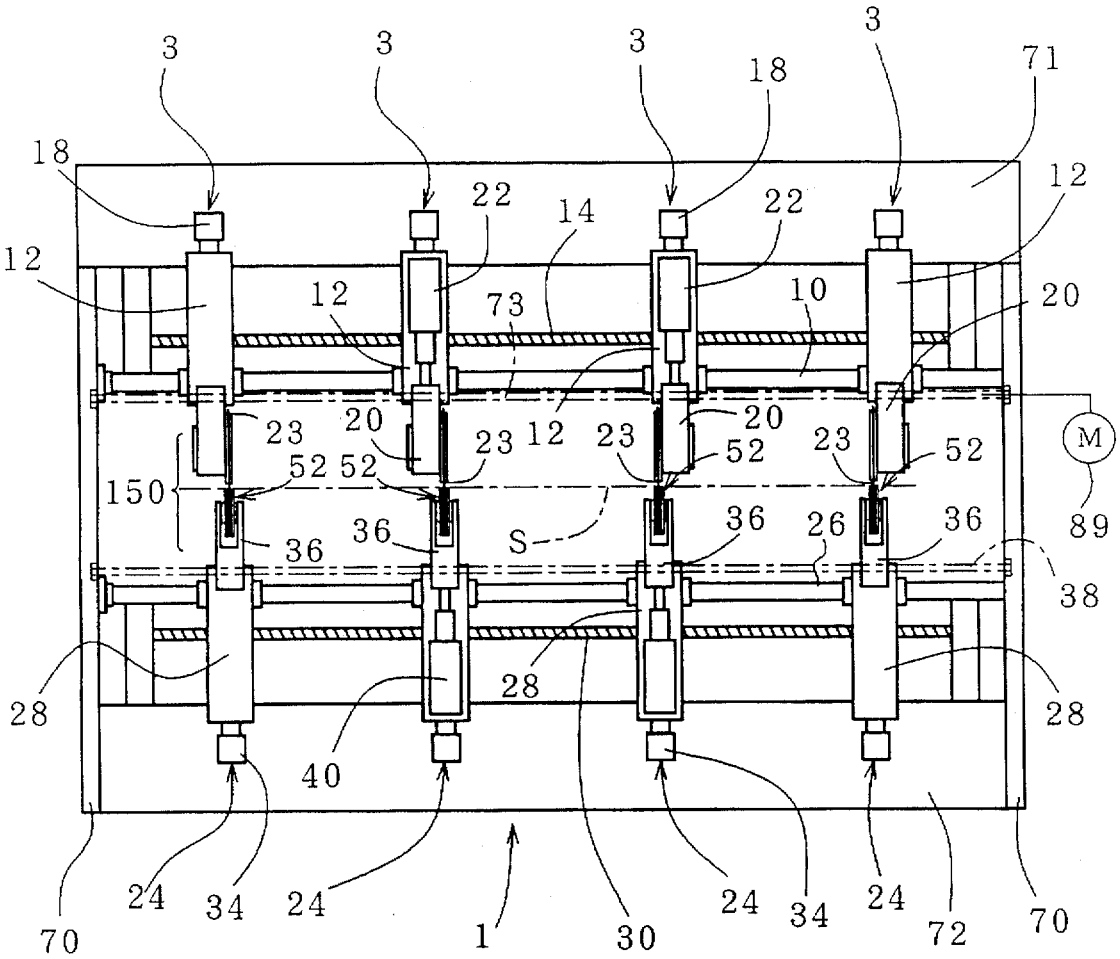
FIG. 1 is a side view presenting the first embodiment of the sheet slitting apparatus relating to this invention.

FIG. 1 presents general construction of the sheet slitting apparatus 1 as an embodiment of this invention. In the apparatus 1, a pair of horizontal beams 71,72 are secured between the frames 70,70 on the lower and upper sides of the feeding line of the sheet S, such as a corrugated board, at a designated distances. The sheet S is fed in the longitudinal direction thereof. Corresponding to these beams 71,72, upper and lower guide rails (first and second guide rails) 10 and 26 are arranged almost parallel thereto. On the upper guide rail 10, plural slitting units 3 are movably mounted. On the other hand, plural supporting units 24, each of which corresponds to respective slitting units 3 by one-to-one, are movably mounted on the lower guide rail 26. Corresponding slitting unit 3 and supporting unit 24 are traversed synchronously in a pair (such pair will be called as a slitter 150, hereafter) along the guide rails 10 and 26. Each slitter 150 is actuated independently.

Figure 2:
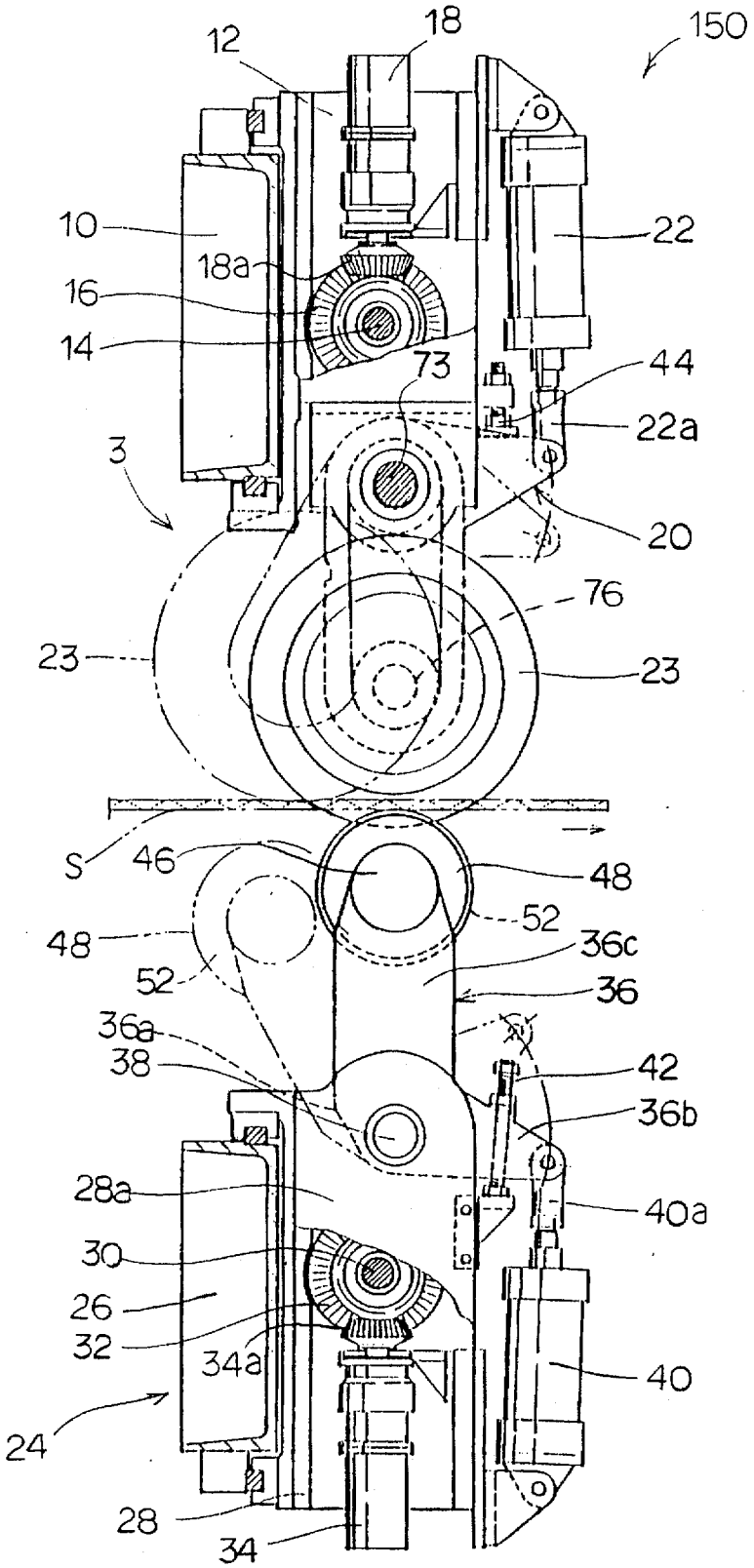
FIG. 2 is a partial sectional front view presenting the main part of the apparatus in FIG. 1.

FIG. 2 presents the detail of one of the slitters 150. In the slitting unit 3, a slitting yoke 12 is movably mounted on the upper guide rail 10 which extends along the width of the sheet S. On the slitting yoke 12, a nut 16 toothed on its circumference is mounted along with a servo motor 18. On the other hand, a threaded shaft 14 is arranged almost parallel to the guide rail 10, and the nut 16 is screwed thereon. The motor 18 rotates the nut 16 forwardly or reversely through a bevel gear 18*a* engaging with the teeth formed on the nut 32, thereby traversing the slitting yoke 12 bidirectionally along the threaded shaft 14 with allowing to stop at an arbitrary position on the shaft 14.

Figure 3:
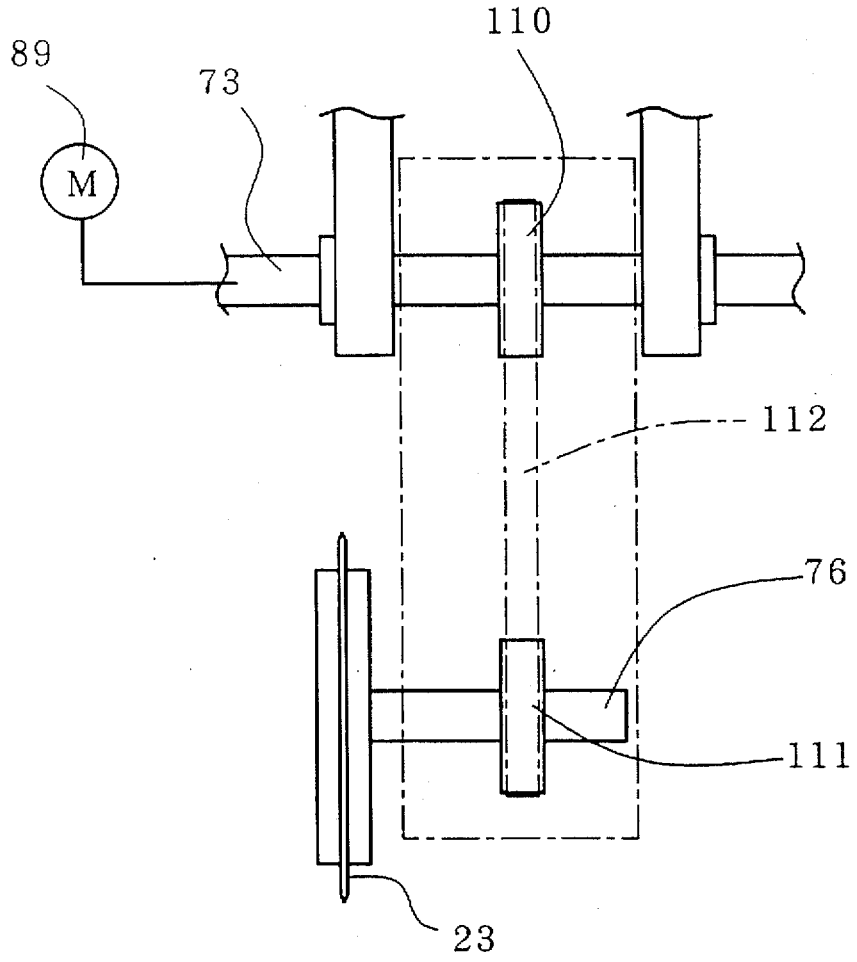
FIG. 3 is a schematic illustration of the driving mechanism for blade rotation.

A slitting head 20 is pivotally mounted on the slitting yoke 12 with a shaft (first pivotal shaft) 73 which is rotatively supported between the frames 70 (FIG. 1) at each end thereof. As shown in FIG. 3, a disk-like slitting blade ("blade", hereafter) 23 is rotatively supported by a shaft 76 in the slitting head 20. The shaft 73 is rotated by a motor 89 (FIG. 1) and function as a blade driving shaft. The rotation of the shaft 73 is transmitted to the blade 23 by a transmitting mechanism comprising, for example, a sheave 110 on the shaft 73, a sheave 111 on the shaft 76 and a belt 112 mounted on these sheaves 110 and 111, thereby rotating the blade 23 in the direction of sheet feeding.

As shown in FIG. 2, a piston rod 22*a* is pin-connected with the slitting head 20 at the end thereof and actuated by a cylinder 22 the bottom of which is pin-connected with the slitting yoke 12. The piston rod 22*a* is extended and retracted by the cylinder 22 thereby swinging the blade 23 between a slitting position (presented by a solid line) and an idling position (presented by a two-dot chain line in FIG. 1). The blade 23 may be moved linearly between the slitting and idling positions by using a linear actuator (such as a cylinder) which moves the slitting head 20 linearly.

The sheet supporting unit 24 is arranged in opposition to the blade 23 under the feeding line of the sheet S. In the supporting unit 24, a supporting yoke 28 is movably mounted on the lower guide rail 26 which extends along the width of the sheet S. On the supporting yoke 28, a nut 32 toothed on its circumference is mounted along with a servo motor 34. On the other hand, a threaded shaft 30 is arranged almost parallel to the guide rail 26, and the nut 32 is screwed thereon. The motor 34 rotates the nut 32 forwardly or reversely through a bevel gear 34*a* engaging with the teeth formed on the nut 32 thereby traversing the supporting yoke 28 bidirectionally along the threaded shaft 30 with allowing to stop at an arbitrary position on the shaft 30. The supporting yoke 28 is traversed synchronously with the slitting yoke 12.

The base portion 36*a* of the supporting head 36 is pivotally mounted on the supporting yoke 28 with a shaft (second pivotal shaft) 38 which is supported between the frames 70,70 (FIG. 1) at each end thereof. A lever potion 36*b* is formed on the base portion 36*a* extending to the lower stream side of the sheet feeding. A piston rod 40*a* is pin-connected with the lever portion 36*b* at the end thereof and actuated by a cylinder 40 the bottom of which is pin-connected with the supporting yoke 28. The piston rod 40*a* is extended and retracted by the cylinder 40 thereby moving the supporting disk group 52, which form a guiding members between a supporting position (presented by a solid line) and an idling position (presented by a two-dot chain line). The supporting disk group 52 may be moved linearly between the slitting and idling positions by using a linear actuator (such as a cylinder) which moves the supporting head 36 linearly. In this embodiment, the supporting yoke 28 and the supporting head 36 consist of the traversing portion.

In FIG. 2, the part indexed as 42 is an adjusting bolt which is screwed into the supporting head 36 and adjusts the slitting position of the supporting disk group 52. Furthermore, the part indexed as 44 is an adjusting bolt which is screwed into the slitting yoke 12 and adjusts the slitting position of the blade 23.

Figure 4:
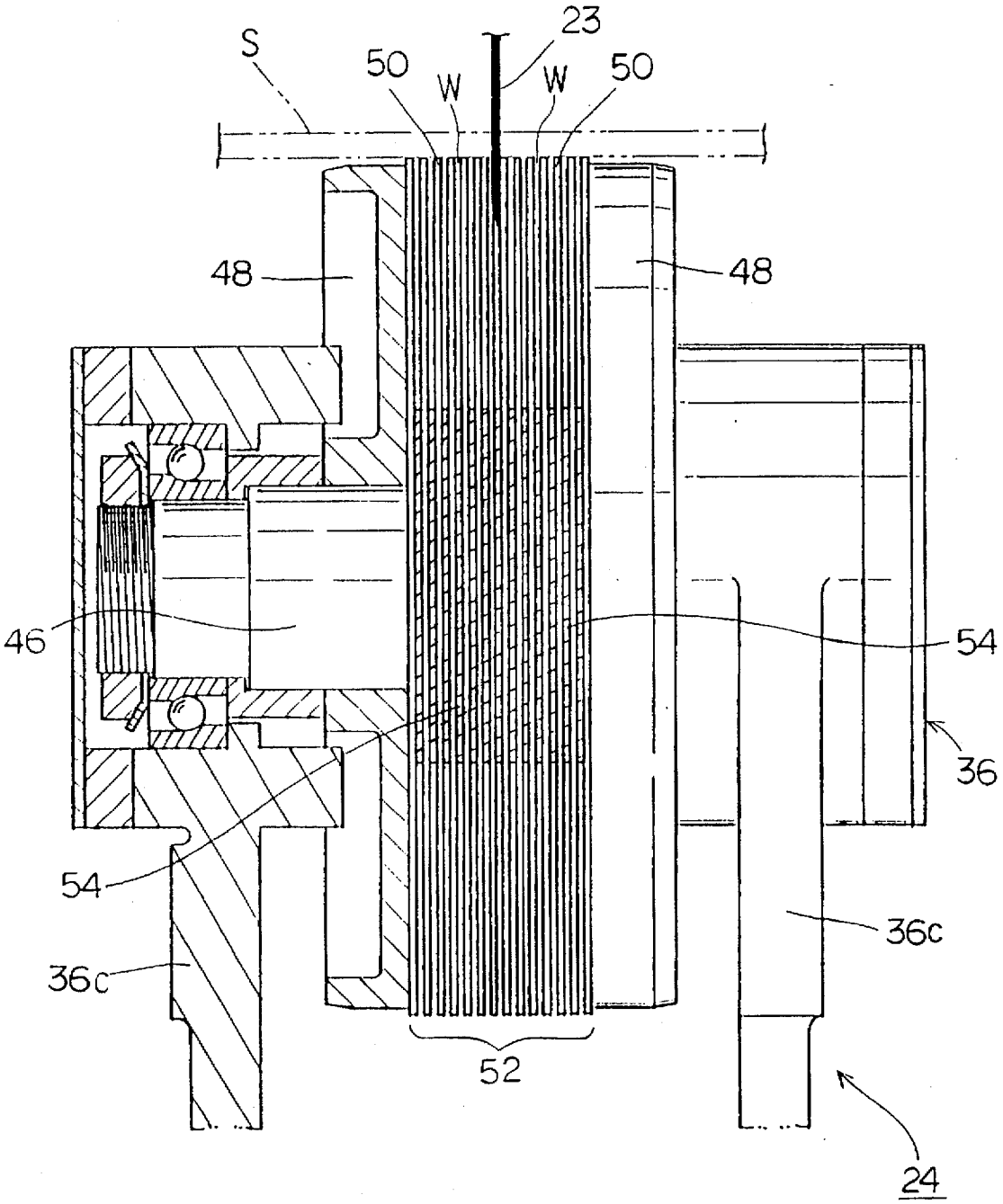
FIG. 4 is a partial sectional front view presenting the main part of the supporting unit for the apparatus in FIG. 1.

On the base portion 36*a* of the supporting head 36, a pair of arms 36*c*,36*c* are integrally provided in a direction crossing that of sheet feeding with forming a designated gap therebetween. As shown in FIG. 4, a supporting shaft 46 is extending along the width of the sheet S and supported between the end portions of the arms 36*c*,36*c* so as to be able to rotate freely in the direction of sheet feeding. On the intermediary portion of the supporting shaft 46 between the arms 36*c*,36*c*, a pair of rollers 48,48, which is arranged along the shaft 46 so as to form a designated distance therebetween, and a plurality of thin plate-like supporting disks 50 (forming a supporting disk group 52 as a guiding member), which is arranged between the rollers 48,48, are mounted so as to integrally rotate with the shaft 46, respectively. Each supporting disk 50 has a diameter almost the same as the roller 48, and the lower surface of sheet S is supported by the disk group 52 and the rollers 48,48 at the circumferences thereof.

Between each adjacent supporting disks 50,50, a spacer 54 having a diameter smaller than each supporting disk 50 and a thickness smaller than the blade 23 is inserted for forming a gap W between the side surfaces of the adjacent disks 50,50. As shown in FIG. 4, when the blade 23 and corresponding supporting disk group 52 are positioned in the slitting and supporting positions, respectively, the tip of the blade 23 intrudes into the gap formed between the adjacent disks 50,50. The blade 23 is rotated at a speed 1.5–5 times as high as that of the sheet feeding, thereby slitting the sheet S in the longitudinal direction (feeding direction) thereof.

The thickness of each spacer 54 is adjusted so as to make the gap W narrower than the thickness of the slitting blade 23. The tip of the blade 23 is to enter into the gap W with deflecting the supporting disks 50,50 outwardly . The supporting disks 50 are made of a flexible material, such as plastics or fiber reinforced plastics (for example, plastics reinforced with glass or carbon fibers).

As shown in FIG. 1, the apparatus 1 comprises plural slitters 150. This embodiment comprises 4 slitters (which are successively numbered as No. 1–4 along the width of the sheet S), outermost two ones of which slit both edge portions of the sheet S for trimming and inner two ones of which slit the sheet S into plural (maximum is 3) webs.

Figure 5:
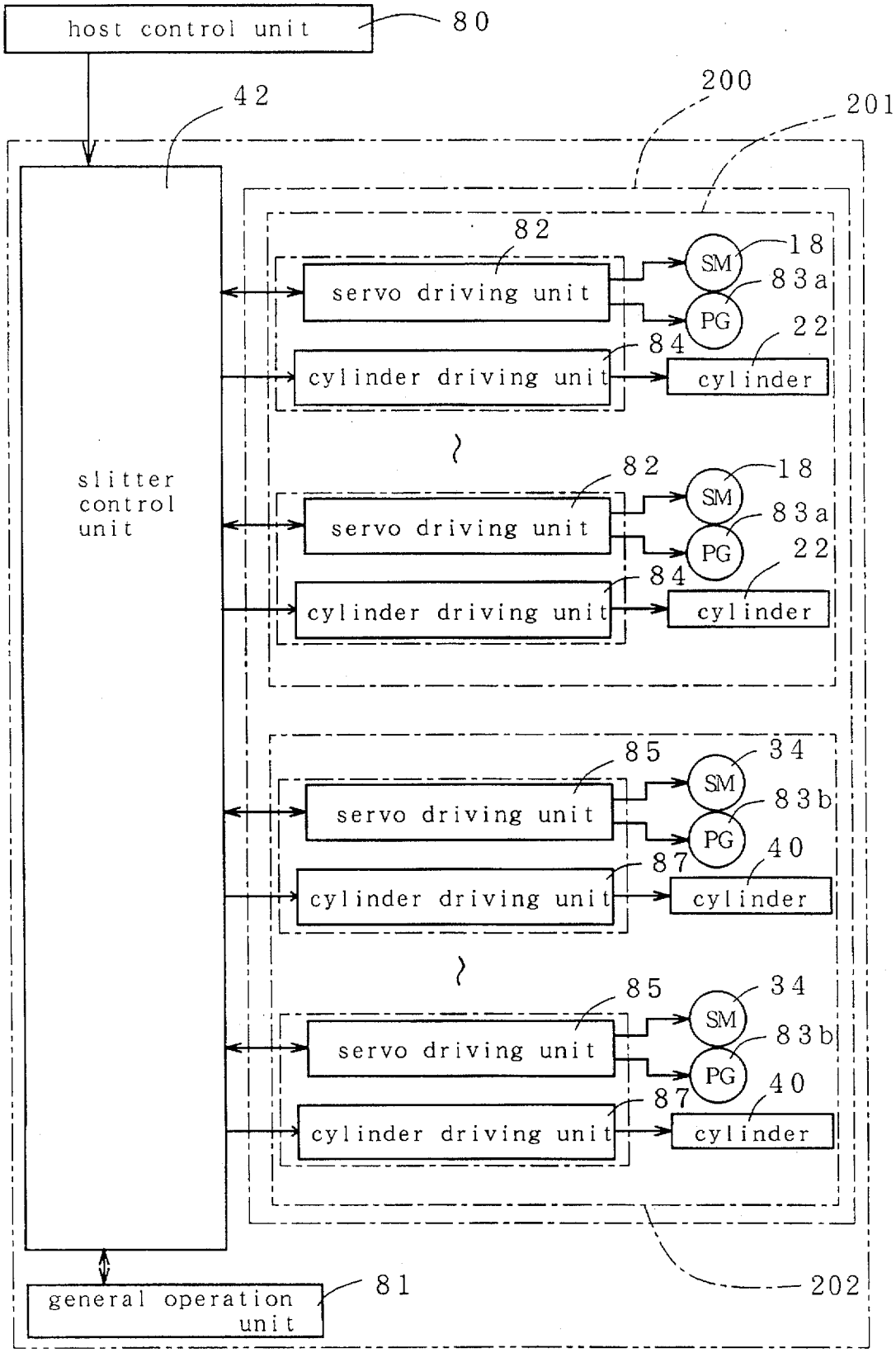
FIG. 5 is a block diagram presenting an embodiment of the controlling system for the apparatus in FIG. 1.

FIG. 5 presents the block diagram of the controlling system of the apparatus 1. The host control unit 80 controls the whole process for manufacturing the corrugated board (sheet S) comprising the slitting step and stores the variables providing number of webs to be slit from the sheet and width of each web, and so on, and a controlling program. These variables and program may be stored in the slitter control unit 42 in the apparatus 1. This slitter control unit 42 is connected with the host controlling unit 80.

A general operation unit 81 consisting of a keyboard or a touch panel is connected with the slitter control unit 42. Further more, a driving unit 200 for positioning each slitter 150, and for loading (i.e., moving the blade 23 and disks 50 to the slitting and supporting positions, respectively) and unloading (i.e, moving the blade 23 and disks 50 to the respective idling position) of the slitter 150 is also connected with the slitter 150 controlling unit 42. The driving unit 200 comprises blade driving unit 201 for driving each blade unit 3 and supporting disk driving unit 202 for driving each supporting unit 14.

The blade driving unit 201 comprises a plurality of servo driving units 82 each of which corresponds to respective blade unit 23. To each servo driving unit 82, the servo motors 18 of corresponding slitting unit 3 and a pulse generator 83*a* for detecting the current position of the slitting unit 3 is connected. The signals of detection from the pulse generator 83*a* are fed back to corresponding servo driving unit 82. The blade driving unit 201 also comprises cylinder driving units 84 which actuate the cylinders 22 for loading and unloading the blades 23. Although only two pairs of the servo driving unit 82 and cylinder driving unit 84 are drawn in FIG. 1, the same number of such pairs as the slitting units 3 are connected with the slitter control unit 42.

Each supporting disk driving unit 202 has almost the same constitution of corresponding blade driving unit 201, i.e., comprising servo driving units 85 for driving the servo motors 34, pulse generator 83*b* for detecting the current position of the supporting unit 24 and cylinder driving unit 87 for driving the cylinders 40.

Figure 6:
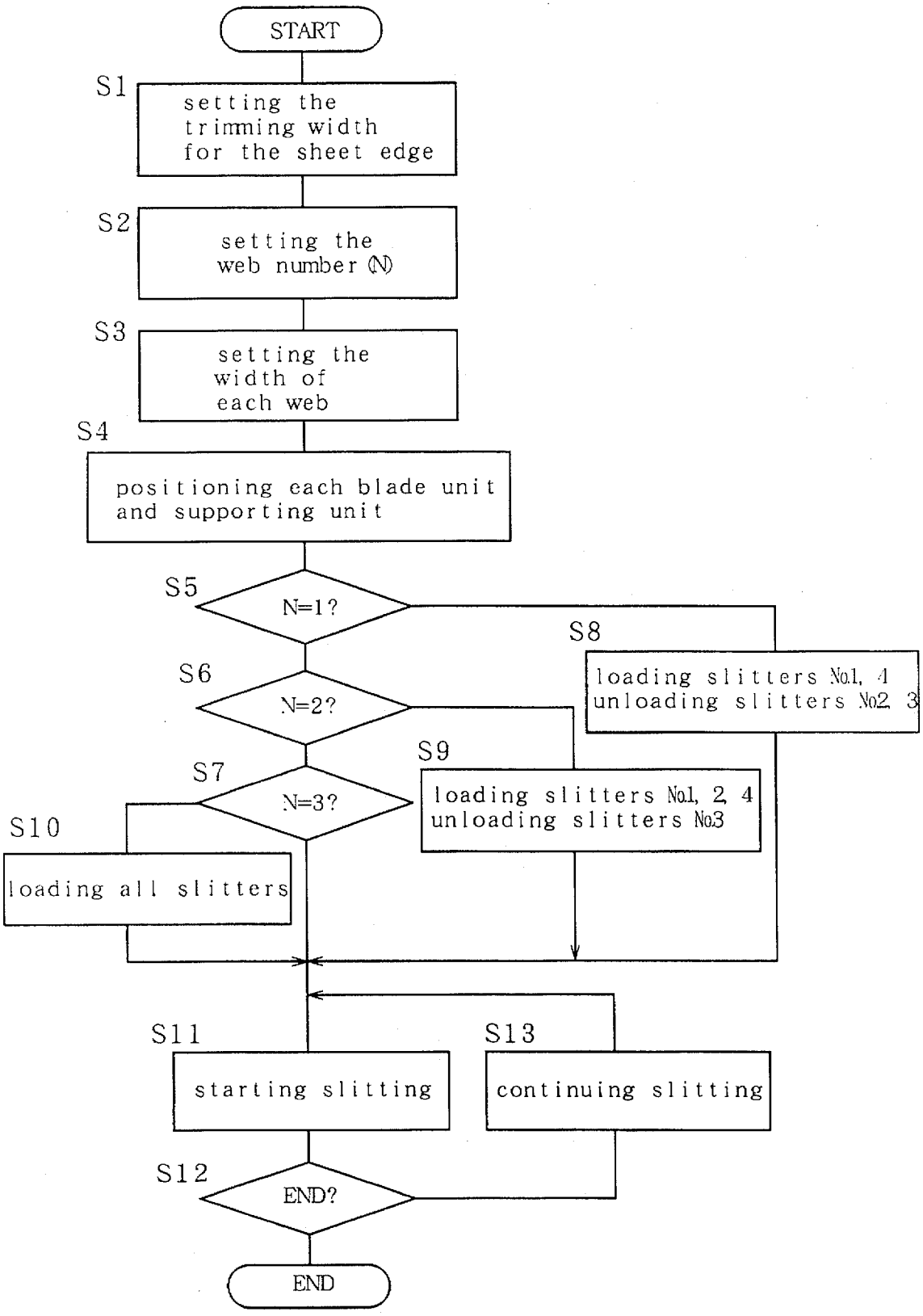
FIG. 6 is a flowchart presenting the controlling flow for the apparatus in FIG. 1.

Now, the operation of the apparatus 1 is going to be explained on referring to FIG. 6. In the steps S1–S3, the trimming width for the sheet edges, web numbers (N) and width of each web are registered to the host controlling unit 80, and in step S4, each slitter 150 is moved to the designated position according to the trimming width, web number and web width registered. After that, the slitters 150 are loaded for slitting the sheet. The inner two slitters 150 (No. 2 and 3) are selectively used according to the web number N, i.e., slitters No. 2 and 3 are unloaded if N=1, slitter No. 3 (or No. 2) is unloaded if N=2, and all slitters are loaded if N=3 (steps S5–S10).

As shown in FIG. 4, the blade 23 intrudes into the gap W between the adjacent supporting disks 50,50 with deflecting them outwardly by loading. Then, the blades 23 start rotating in this state thereby slitting the sheet S (S11–S13). The blade 23 and supporting disk 50,50 are contacting each other, and the disk group 52 and the rollers 42 rotate at the same speed as the blade 23, so that the sheet feeding is not interfered.

The arrangement of the slitting units 3 and the supporting unit 24 may be inverted. In this case, the slitting units 3 are located on the lower side of the sheet S, and the supporting units 24 are located on the upper side thereof. In this case, following advantage may be expected. The corrugated board as the sheet S is manufactured in the upper stream of the slitting apparatus 1 in such way that a liner fed from the lower side is bonded to a single faced corrugated board fed from the upper side in a double facer. In the case that the slitting blade 23 is located on the upper side of the feeding line, the blade urges the liner in the direction of peeling off the liner from the single faced board during slitting. Therefore, if the bonding state between the liner and the single faced board is imperfect, the liner may be peeled off by the urging force from the blade 23. However, the blade 23 arranged on the lower side of the feeding line urges the liner so as to bonding it to the single faced board, so that such problem may be evaded.

Figure 11:
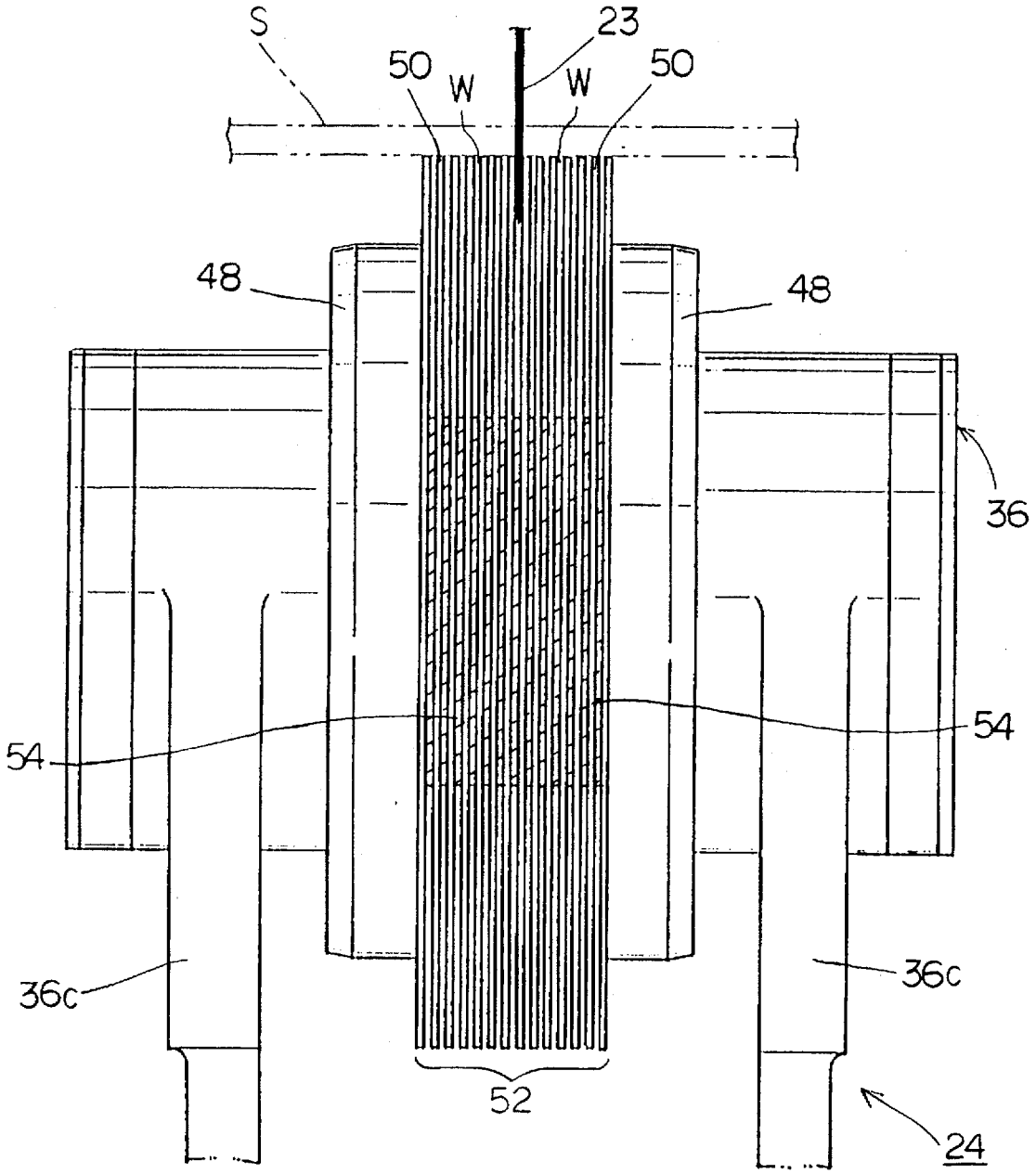
FIG. 11 presents a modification of the supporting unit.

As shown in FIG. 11, the supporting disks 50 may be formed so as to have a diameter larger than the rollers 48. In this case, the sheet S is to be slit only under a support by the disks 52.

Figure 7A:
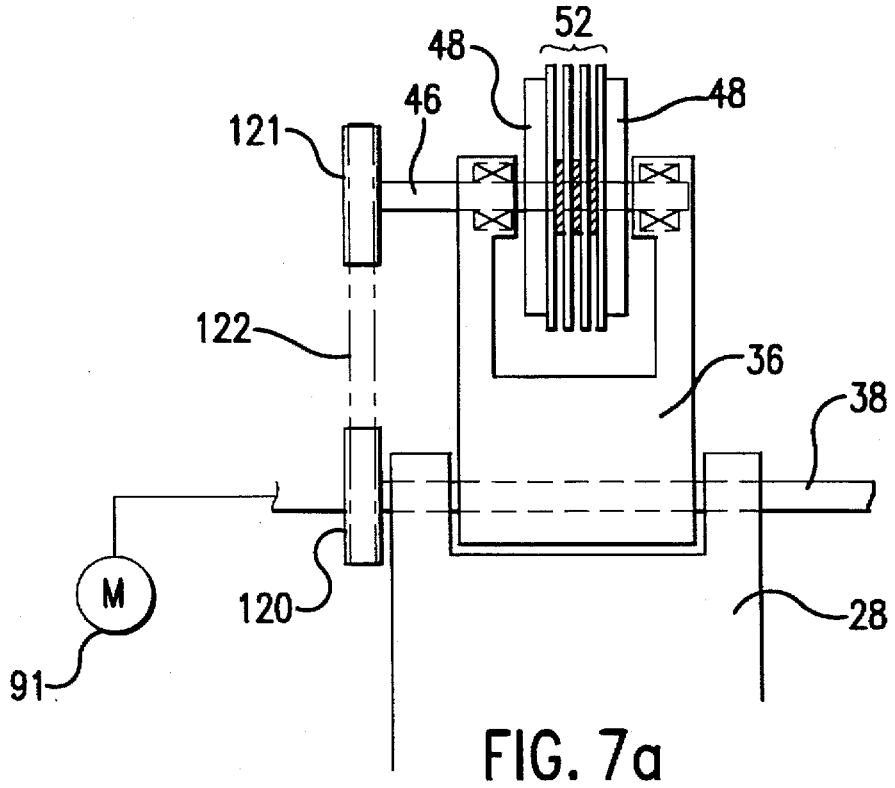
FIG. 7*a* is a schematic illustration of the driving mechanism for rotating the supporting disks.
Figure 7B:
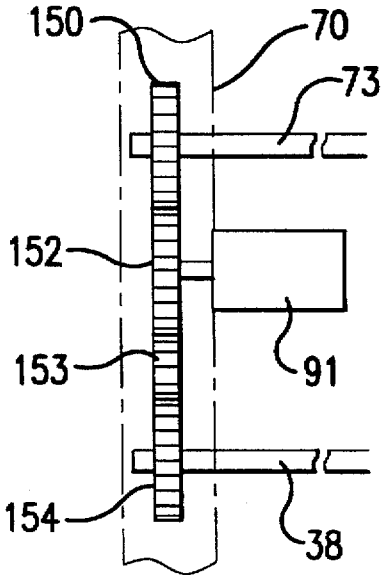
FIG. 7*b* is an illustration of a driving mechanism for the supporting disks.

On the other hand, the rotation of the supporting disks 50 can be aided by using a driving means. FIG. 7(*a*) presents an embodiment thereof. The shaft 38 which pivotally connects the supporting head 36 with the supporting yoke 28 functions as a driving shaft for rotating the supporting disks 50 (driven by a motor 91, for example). The rotation of the shaft 38 is transmitted to the supporting disks 50 by a transmitting mechanism comprising, for example, a sheave 120 on the shaft 38, a sheave 121 on the shaft 46 and a belt 122 mounted on these sheaves 120 and 121, thereby rotating the disks 50 in the direction of sheet feeding. The transmitting mechanism may be constructed also as a gear mechanism.

The supporting disks 50 may be rotated at the same speed as the rotation of the blade 23 though, it is preferable to rotate them at almost the same speed as the sheet feeding since a rubbing between the circumferences of the supporting disks 50 and the sheet S, which may damages the sheet surface, can be avoided. The rotation speed of the disks 50 may be set to be a little faster than the sheet feeding speed. In this case, the rotation of the disks 50 may provide an effect of aiding the sheet feeding.

Furthermore, the shaft 73, which pivotally connects the slitting yoke 12 with the slitting head 20 and drives the blades 23, and the shaft 38, which pivotally connects the supporting head 36 with the supporting yoke 28 and drives the supporting disks 50, may be driven by a common driving means. FIG. 7(*b*) presents a specific embodiment thereof. The shaft 73 and 38 are driven by a motor 91 through respective transmitting mechanisms. In this embodiment, the transmitting mechanism for the shaft 73 comprises a gear 150 mounted on the end of the shaft 73 and a gear 152 directly rotated by the motor 91, and that for the shaft 38 comprises a gear 154 mounted on the end of the shaft 38, the aforementioned gear 152 and a gear 153 engaged between the gears 152 and 154. In the case that the supporting disks 50 are to be driven slower than the blade 23 (for example, driven at the same speed as the sheet feeding), the rotation of the motor 91 is to be transmitted to the shaft 38 thorough a reduction mechanism. In this embodiment, it is constituted by gears 153 and 154 in FIG. 7(*b*).

In the embodiment explained above, both the blades 23 and the supporting disks 50 are mounted movably between the slitting position and the idling position though, the supporting disks 50 may be arranged fixedly in the supporting position. In this case, the disks 50 are traversed along the sheet width in a state of being held in the slitting position.

Figure 12A:
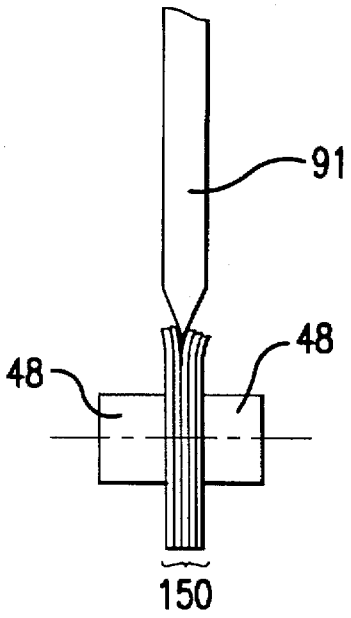
FIGS. 12*a* and 12*b* present several modifications of the supporting unit.
Figure 12B:
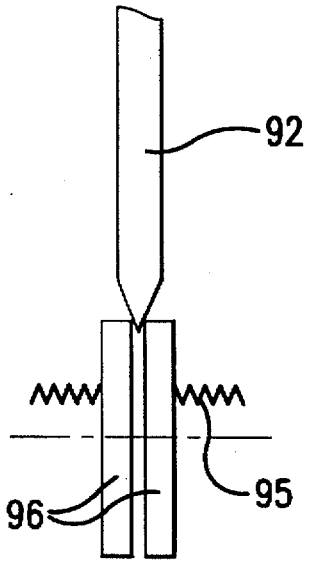

As shown in FIG. 12(*a*), plural rings 150 which are arranged contacting each other and each of which can elastically deforms with the intrusion of the blade 23 may be used in stead of flexible disks 50. Furthermore, the blade 23 may be guided by a pair of rigid disks 96 which are urged by springs 95 in the direction of approaching each other and allow the intrusion of the blade 23 by contracting the springs 95.

(second embodiment)

Figure 8:
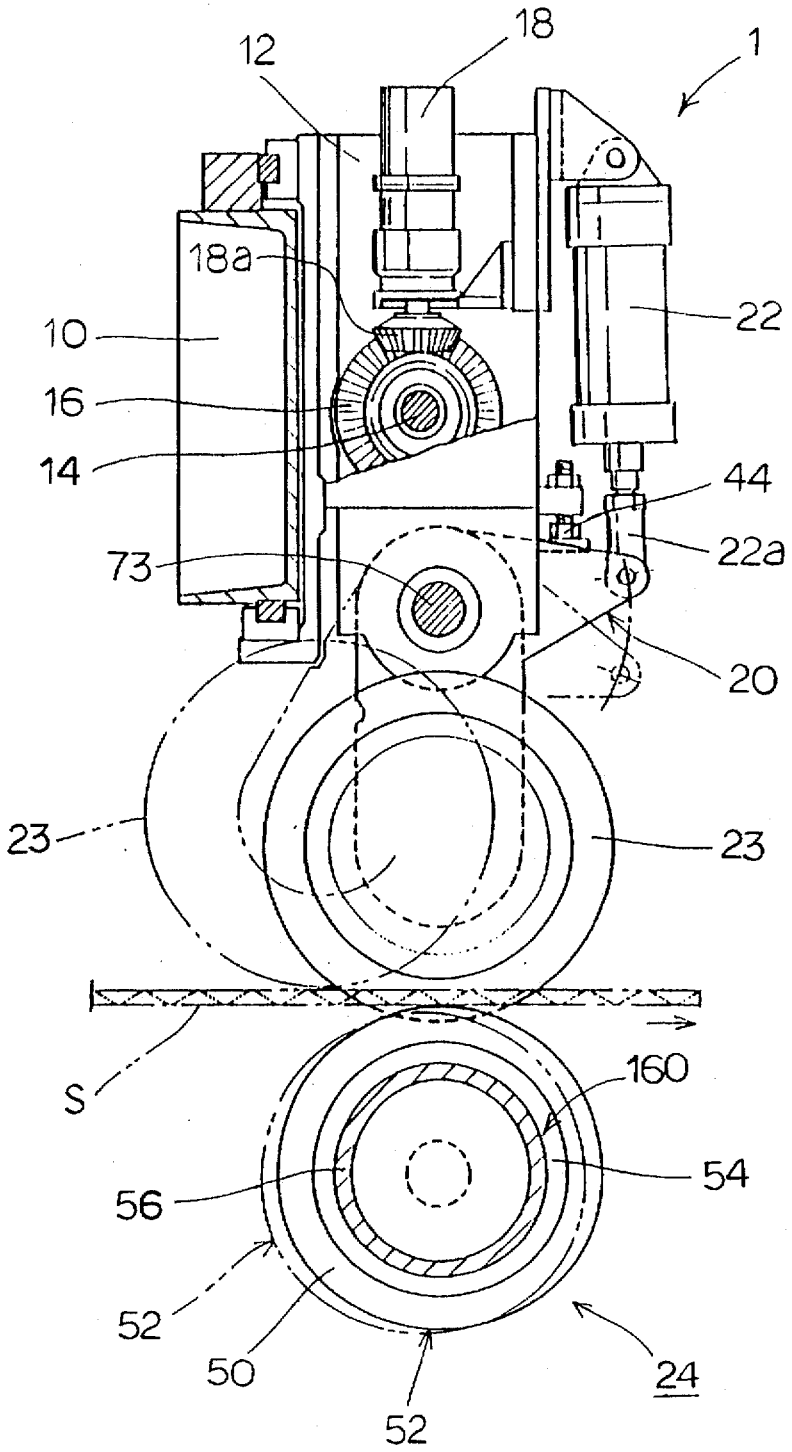
FIG. 8 is a partial sectional side view presenting the main part of the second embodiment of the sheet slitting apparatus relating to this invention.
Figure 9:
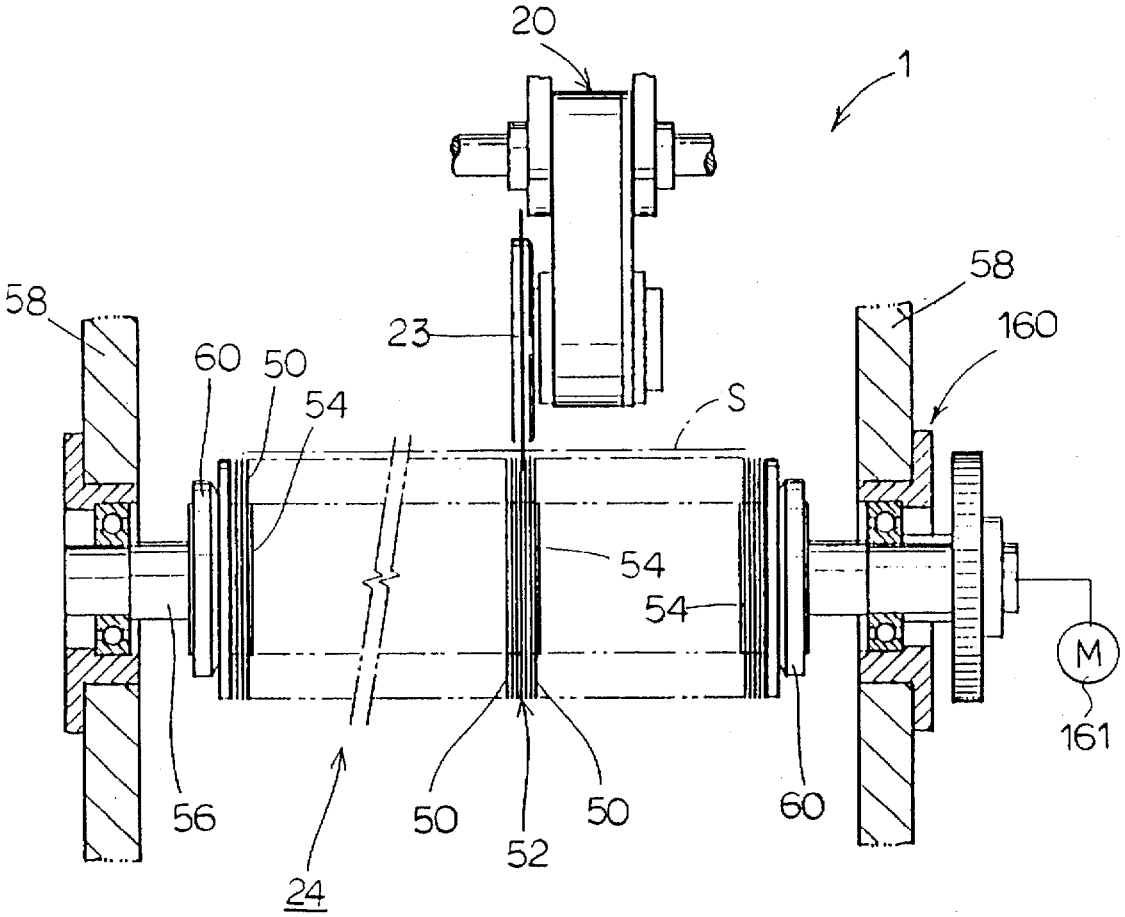
FIG. 9 is a partial sectional front view of FIG. 8.
Figure 10:
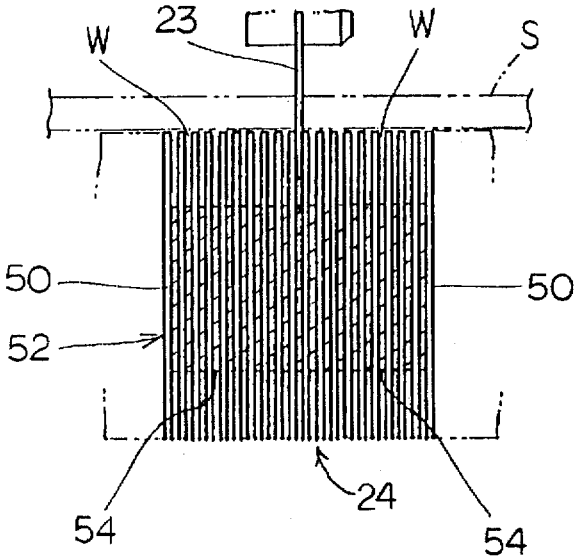
FIG. 10 is a front view presenting the main part of the supporting unit for the apparatus in FIG. 8.

FIGS. 8–FIG. 10 present the second embodiment of this invention. As shown in FIG. 9, the supporting disks 50 are arranged over almost total width of the sheet S. Under the feeding line of the sheet S, a horizontal supporting shaft 56, extending in the direction crossing over the feeding line is rotatively supported between frames 58,58 of the apparatus 1. As shown in FIGS. 9 and 10, many supporting disks 50 are mounted on the shaft 56 along the axial direction thereof. Between each adjacent supporting disks 50, a spacer 54 having a diameter smaller than each supporting disk 50 and a thickness smaller than the blade 23 is inserted for forming a gap W between the side surfaces of the adjacent disks 50. As well as the first embodiment, the tip of the blade 23 intrude between adjacent disks 50 with deflecting them outwardly. These supporting disks 50 are mounted on the shaft 56 within a section of almost the same length as the maximum width of the sheet S to be slit in the apparatus 1. The parts indexed as 60,60 in FIG. 9 are securing members for positioning and securing the disks 50 and spacers 54 on the shaft 56.

The shaft 56 is supported by the frames 58,58 through an eccentric mechanism 160 (partly presented in FIG. 9), which is driven by an undrawn driving means. As shown in FIG. 8, the eccentric mechanism 160 moves the shaft 56 up and down for adjusting the position thereof. The shaft 56 (i.e., the disks 50) may be provided so as to be able rotates freely, or to be driven at the same speed as the sheet feeding by a motor 161.

In this embodiment, although the function of the supporting disks 50 and the blade 23 during slitting is almost the same as that in the first embodiment, the disks 50 are fixedly arranged over the total width of the sheet S, so that there is no need to adjust the position of the supporting unit 24 for order changing.

That which claimed is:

1. A sheet slitting apparatus for longitudinally slitting a sheet fed in the longitudinal direction thereof comprising:

a disk slitting blade which rotates in the sheet feeding direction, and which can move in a sheet width direction generally perpendicular to said sheet feeding longitudinal direction;

a guiding member located in opposition to said slitting blade and comprising a plurality of supporting disks having an axis of rotation extending in said sheet width direction, each said supporting disk is formed in the shape of a thin, circular plate of flexible material such that said supporting disks can each displace elastically along the sheet width direction, and each supporting disk is spaced from adjacent supporting disks to form a plurality of gaps, each said gap being narrower than a thickness of the slitting blade;

wherein said slitting blade is moved in said sheet width direction and a tip of said slitting blade is inserted into one of said plurality of gaps thus deflecting the supporting disks on both sides of said slitting blade tip, wherein said sheet is fed between said slitting blade and said guiding member thereby slitting said sheet along the longitudinal direction thereof.

2. A sheet slitting apparatus according to claim 1 comprising a supporting shaft which is arranged along the width of said sheet, and can rotate in said sheet feeding direction, wherein said supporting disks are mounted on said supporting shaft so as to rotate integrally with said supporting shaft, and wherein a spacer having a diameter smaller than said each supporting disk and a thickness smaller than said slitting blade is inserted between each said adjacent supporting disks thereby forming said plurality gap.

3. A sheet slitting apparatus according to claim 1 comprising a driving means for rotating said supporting disks uniaxially in said sheet feeding direction.

4. A sheet slitting apparatus according to claim 1 comprising a supporting shaft which can rotate in said sheet feeding direction;

and wherein said supporting disks which are mounted on said supporting shaft so as to rotate integrally with said shaft and to be able to displace elastically along said shaft.

* * * * *